United States Patent [19]

Sung

[11] 4,057,506

[45] Nov. 8, 1977

[54] HEAVY-DUTY LIQUID DETERGENT

[75] Inventor: Steven Lang Sung, Edison, N.J.

[73] Assignee: Colgate Palmolive Company, New York, N.Y.

[21] Appl. No.: 645,152

[22] Filed: Dec. 30, 1975

[51] Int. Cl.[2] ..... C11D 3/06; C11D 11/00

[52] U.S. Cl. ..... 252/135; 252/523; 252/DIG. 11; 252/DIG. 14; 252/534; 252/539; 252/540; 252/558; 252/559

[58] Field of Search ..... 252/135, 558, 559, 534, 252/539, 540, 523, DIG. 11, DIG. 14

[56] References Cited

U.S. PATENT DOCUMENTS

| | | | |
|---|---|---|---|
| 2,860,107 | 11/1958 | Lamberti et al. | 252/135 |
| 3,075,922 | 1/1963 | Dixon | 252/135 X |
| 3,232,880 | 2/1966 | Mausner et al. | 252/135 X |
| 3,328,309 | 6/1967 | Grifo et al. | 252/135 X |
| 3,509,059 | 4/1970 | Renold | 252/135 |
| 3,629,125 | 12/1971 | Payne, Jr. et al. | 252/135 |

*Primary Examiner*—Mayer Weinblatt
*Attorney, Agent, or Firm*—Norman Blumenkopf; Herbert S. Sylvester; Murray M. Grill

[57] ABSTRACT

A process for preparing homogeneous and stable heavy-duty liquid detergent compositions which comprises forming a blend of a solution of a builder salt and an emulsifying agent at an elevated temperature above about 60° C. and cooling said blend to a lower temperature below about 45° C., the amount of said builder salt dissolved in said solution at the elevated temperature being greater than the solubility of said salt in water at the lower temperature, the nature and amount of the emulsifying agent being such as to maintain the builder salt in stable dispersion in said blend at the lower temperature. The finished composition contains a water-soluble detergent surface active agent.

7 Claims, No Drawings

HEAVY-DUTY LIQUID DETERGENT

BACKGROUND OF THE INVENTION

1. Field of the Invention

This invention is directed to a process for preparing substantially homogeneous and stable heavy-duty liquid detergent compositions which are suitable for all-purpose cleaning.

In the detergent art it has been common practice to prepare detergent compositions in solid particulate form as, for example, by spray dying a slurry of the detergent composition. These products contain in addition to the surface-active agent and various adjuvants, alkaline builder salts such as sodium tripolyphosphate in significant amounts to improve the detergent or washing power of the composition. Particulate detergent compositions are not as versatile in use as liquid detergent compositions for a variety of known reasons and it is highly desirable therefore, to provide a heavy-duty detergent composition in liquid form.

The preparation of a stable, homogeneous heavy-duty liquid detergent however, presents many problems to the formulator since the product should be as concentrated as possible, not separate on storage, perform heavy-duty cleaning comparatively to dry products, and be as economical in usage. The most important underlying problem is to provide a detergent system having sufficient surface active ingredients and builder in a liquid system wherein none of the components will settle out or show unsightly phase separation on storage.

2. Description of the Prior Art

In heavy-duty liquid detergents the compatibility of a builder component with a detergent surfactant is poor and the builder and/or the surfactant are usually reduced in concentration to overcome any phase separation problems, but with a significantly lower detergency effectiveness. This relative insolubility of the materials is further compounded due to the lower solubility of the relatively inexpensive sodium builder salts e.g., sodium tripolyphosphate, as compared to the more expensive and highly soluble potassium salts, which are on the order of three or more times more soluble and which have consequently been preferentially employed by formulators to avoid this problem.

The formulation of a stable, homogeneous heavy-duty liquid detergent which is relatively inexpensive and easy to produce has consequently perplexed those skilled in the art over the years, and the proposed products and processes are still undesirable for a variety of reasons, including difficulty of manufacture, cost, among others. U.S. Pat. Nos. 2,733,213 and 2,733,214 disclose a detergent composition in a paste form, which is not a liquid suitable for the uses contemplated herein. As is well known the viscosity of a paste is well over 200,000 centiposes.

According to U.S. Pat. No. 2,859,182

"Heavy duty liquid detergent compositions may contain one or more synthetic detergents and a polyphosphate in an aqueous medium. However, the presence of a considerable amount of polyphosphate in these compositions causes the synthetic detergents to separate from solution at room temperature thereby making the product commercially unattractive. Hence, the major problem of preparing homogeneous heavy duty liquid detergent compositions involves the discovery of means for preventing the synthetic detergents from separating out of solution at room temperature or below in the presence of a considerable amount of polyphosphate."

This patent purported to solve this problem by using a combination of an alkylolamide and a hydrotrope (such as sodium toluene sulfonate) together with the highly soluble and expensive potassium detergent salts and builder salts; neither the alkylolamide nor the hydrotrope was effective by itself.

According to U.S. Pat. No. 3,023,168 a heavy-duty liquid detergent composition in the form of a stable suspension is obtained using a special triethanolamine detergent salt, expensive and highly soluble potassium tripolyphosphate and sodium carboxymethylcellulose as an essential suspending agent.

Another approach to the solution of this problem is disclosed in U.S. Pat. No. 3,042,623 which uses sodium tripolyphosphate. According to this patent it is "critical" to include large amounts of ammonium sulfate; "solubility of the compositions is impaired if less than 20% of ammonium sulfate is employed."

U.S. Pat. No. 3,232,878 provides a sodium tripolyphosphate "suspension" using soap together with fatty acid alkanolamide; no sulfonate detergent is present. In this patent the solid tripolyphosphate is added to water to give a "smooth cream," presumably a suspension of solid particles of tripolyphosphate, and alkanolamide and soap (in relatively low concentrations up to 10%) are added.

U.S. Pat. No. 3,720,621 states

"TPP has a relatively low solubility in water, the Saturation concentration in water at room temperature being about 164 g/liter, corresponding to about 14 percent by weight. Such low solubility is not a disadvantage for solid detergent compositions, which may for example be in the form of powder, granules, flakes or the like. However such low solubility represents a practically insolvable problem in the formulation of homogeneous liquid detergent compositions, due to the fact that these normally require a TPP content of about 18 or 40 percent by weight as this is the level of concentration in most commercial solid detergent compositions. In fact the proportion of TPP capable of being introduced into liquid detergent compositions is substantially lower than the theoreticl 14 percent by weight (which 9 (sic) the saturation concentration of TPP) due to the presence of particularly of surface-active agents. A well-known effect is that surface-active agents and TPP have a mutual effect on their respective solubilities, the higher the concentration of surface-active agent in liquid compositions the less the solubility of TPP, and vice versa."

According to the patent, the inclusion of potassium and/or ammonium salts of inorganic or organic acids increases the solubility of the sodium tripolyphosphate builder salt. In the detergent formulations shown in the patent a hydrotrope is employed and the only alkylbenzene sulfonate detergents mentioned are the more expensive potassium alkylbenzene sulfonates.

SUMMARY OF THE INVENTION

It has now been discovered that homogeneous and stable heavy-duty liquid detergent compositions which are further characterized by being substantially devoid of any builder salt particles and which are smooth and creamy may be prepared by a process which comprises forming a blend of a solution of said salt and an emulsifying agent at an elevated temperature above about 60° C. and cooling said blend to a lower temperature below about 45° C., the amount of said builder salt dissolved in said solution at said elevated temperature being greater than the solubility of said salt in water at said lower temperature, the nature and amount of the emulsifying agent being such as to maintain the builder salt in stable dispersion in said blend at the lower temperature. Preferred emulsifying agents are fatty acid amides. The finished composition contains a water-soluble detergent surface active agent, such as sodium dodecyl benzene sulfonate. Preferably this is present in the blend at the elevated temperature. Generally, the finished detergent composition contains, in weight percent, an amount of water-soluble detergent in the range of about 5% to 50%, a builder salt in the range of about 5% to 50% and an emulsifying agent in an effective amount, e.g., about 0.1% to 10%.

DETAILED DESCRIPTION OF THE INVENTION

Stable, homogeneous heavy-duty liquid detergent compositions can be prepared by specially combining the water-soluble anionic detergent, builder salt and emulsifying agent. The liquid product, depending on the relative amounts of the ingredients, may be of variable viscosity ranging from a free-flowing liquid to a highly viscous product. The stability and homogeneity of the product means that it has a satisfactory degree of stability during storage life at both room temperature and elevated temperatures, e.g., 120° F., for periods of at least up to about four weeks or more, and even 6 months or more against separation or formation into a plurality of distinct layers. The product is further characterized by being substantially devoid of any solid particles which tend to settle out on standing and/or cause a gritty feeling on the hands. Thus, a sample of liquid detergent containing tripolyphosphate prepared in accordance with the invention did not show any solid phase settling out even when centrifuged at high speeds. This indicates that any sodium tripolyphosphate that may have been present in solid form was in the form of colloidal-size particles (e.g., below about 1 micron, and probably below 0.1 micron in size). Further, the product is generally translucent but is noted be be transparent at film thicknesses up to at least about 3 millimeters (mm.) so that one can, for example, read printing through said film.

If a slight amount of separation occurs due to, for example, extreme temperature changes in storage conditions, it is an important feature of the invention that the product be readily redispersed by lightly shaking the container. Further, it is a special feature of the invention that the composition not crystallize under storage conditions, which would detrimentally affect the smooth, creamy texture of the product, making it somewhat coarse and gritty. Viscosity measurements using a Brookfield viscometer, Model RVF, at 4 revolutions per minute (r.p.m.) with a Number 4 spindle range up to about 50,000 centipoises (cps.) or more, depending on the ingredients employed and the concentrations thereof. A particularly preferred product has a viscosity of about 5,000 to 15,000 and is characterized by being free flowing and, when dispensed from a measuring cup, drains relatively easily therefrom. Products having viscosities up to about 30,000 cps or 40,000 cps are particularly suitable for such uses as hand washing of clothes.

The water-soluble detergent is preferably anionic in nature and it is a feature of this invention that the effects are particularly obtained with anionic detergents such as alkylbenzene sulfonic acid and its salts, and compounds of the formula alkylphenyl-$SO_3$-M, wherein alkyl is either linear or branched and is an alkyl radical of $C_8$ to $C_{22}$ and preferably $C_{10}$ to $C_{18}$ and M is hydrogen or an alkali metal, which compounds comprise a well-known class of anionic detergents and include sodium dodecylbenzene sulfonate, potassium dodecylbenzenesulfonate, sodium laurylbenzenesulfonate, and sodium cetylbenzenesulfonate.

These various anionic detergents are generally used in the form of their water-soluble salts, such as the alkali metal, alkaline earth metal, ammonium, amine, and alkylomanine salts. While the sodium, potassium, ammonium, and alkylolamine (e.g. mono-, di-, and triethanolamine) salts are preferred ordinarily, other salts such as the lithium, calcium, and magnesium salts may be used if desired. For the uses contemplated herein, it is preferred to use the sodium salt. The concentration of the water-soluble detergent salts (including suitable mixtures thereof) in the detergent compositions of the present invention is, by weight, about 5% to about 50% and preferably about 10% to about 30%, e.g., 15%–20%.

Others are the alkali metal salts of the paraffin sulfonic acids, alkyl sulfates, olefin sulfonates, alcohol ether sulfates, and alkylphenoxyethoxyethanol sulfates such as sodium hexadecanesulfonate, sodium tetradecane sulfonate, sodium n-lauryl sulfate, sodium n-hexadecyl sulfate, sodium octylphenoxynonaethoxyethylsulfate, sodium dodecenyl-1 sulfonate, sodium hexadecenyl-1 sulfonate, and sodium lauroxypentaethoxyethanol sulfate.

Other water-soluble detergents contemplated herein are well known in the prior art, the term detergent comprehending species of the anionic, nonionic, cationic, amphoteric and zwitterionic types, and mixtures thereof, with the proviso that the detergent be compatible with the builder salt emulsion to form a homogeneous and stable heavy-duty liquid detergent product.

An important builder salt contemplated herein is sodium tripolyphosphate, in either the anhydrous or hydrated form. Other water-soluble tripolyphosphate salts for example, the potassium salt, may suitably be employed, but these are relatively expensive and, because of their greater solubility, special processing procedures are usually not required to provide a homogeneous, stable heavy-duty liquid detergent product. Other water-soluble phosphate salts may be employed such as the pyrophosphates or orthophosphates, but these are not as effective builders as the tripolyphosphates. Mixtures of the above may be used but it is contemplated herein that sodium tripolyphosphate be the major builder salt. The amount of tripolyphosphate salt is from about 5% to about 50% or more, and is preferably about 10% to about 30%, and most preferably about 15% to 20%.

As is known in the art, there are two anhydrous varieties of sodium tripolyphosphate (Forms I and II), both of which are considerably more soluble than the hexahydrate. Form I is known at the "lumping variety" because when added to water, it lumps or cements together because of its high solubility and rapid rate of nucleation of hexahydrate crystals which causes a nearly instantaneous drop in the concentration of dissolved solids. Form II, on the other hand, is less metastable in water than Form I and instead remains high in dissolved phosphate and only gradually decreases in solubility over a period time, which may be hours. For these reasons, it is preferred to utilize a material containing an excess of Form II, and commercial varieties normally contain greater than 50%, as high as 90%, by weight, of Form II. Further, while the mechanism of the method of this invention is not known, it is preferred that the sodium tripolyphosphate blend be maintained at an elevated temperature for periods less than one day, and more preferably less than about 5 to 10 hours and most preferably less than about 2 hours to avoid any difficulties with degradation of the tripolyphosphate, or even solubilization of the tripolyphosphate salt.

Other water-soluble builders can be inorganic or organic in nature and can be selected from a wide variety of known builder materials such as silicates, borates, carbonates, bicarbonates, phosphates, citrates, organic acids and water-soluble salts thereof, e.g., polyacetates, polycarboxylates, among others including mixtures thereof. An amount of about 5% to about 30%, or more, e.g., 50% may be suitable employed depending on the water solubility of the salt and its compatibility with the detergent component.

The emulsifying agent may be any suitable component which will provide a homogeneous, stable builder salt emulsion and/or heavy-duty liquid detergent composition according to the process as described herein. Amounts of generally about 0.1% to 10% are normally employed. Higher amounts, e.g., 20% or more may be required in some instances of extreme incompatibility of the ingredients or high detergent or builder concentrations.

An especially preferred clase of emulsifying agent are the fatty acid amides having the formula:

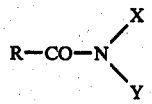

wherein R-CO is an aliphatic acyl radical, having from about 10 to 22, and preferably about 12 to 16 carbon atoms, and X and Y may each be selected from the group consisting of hydrogen, and alkyl and alkylol radicals of 1 to about 5 carbon atoms each, and preferably about 2 carbon atoms. Specific examples of amides which comes within the scope of the invention are: palmitylethanolamide, cocomonoethanolamide, myristylethanolamide, laurylethanolamide, oleylethanolamide, myristamide, lauramide, stearamide, lauric diethanolamide, and amide type mixtures prepared from mixtures of higher fatty acids derived from various fats, oils, and waxes or animal, vegetable or marine origin. A particularly preferred amide is a mixture of lauric diethanolamide and myristic diethanolamide having a weight ratio of about 70 to about 30, respectively. Based on the weight of the composition, the amide is present in amounts from .1% to about 10%, preferably about 1% to about 6% and most preferably about 2% to about 4%. The amides may also be used in other forms of desired, for example, ethoxylated, esterified and sulfated, among others. The ethoxylated adducts will usually contain from about 1 to 6 moles, or more, of ethylene oxide.

The compositions may contain additional ingredients which are usual in detergent compositions such as perfume, coloring agents, brighteners, etc. which do not interfere with the cleaning performance and the stability and homogeneity of the detergent composition. Solvent type alcohols, such as ethanol, and hydrotraper, such as sodium xylene sulfonate are not required and in fact are to be avoided in excessive amounts which may cause undesirable phase separation of the composition or interfere with the process of making the composition, e.g., dissolution of the components, among others.

In one preferred embodiment the composition may be prepared by dissolving the detergent in water and heating to the desired temperature, e.g., 175° F.–185° F. The builder salt is than dissolved in the heated solution and the emulsifying agent added with sufficient agitation to form the emulsion. When anhydrous sodium tripolyphosphate is used, since it is exothermic on dissolution, it is preferred that the heat source be removed when adding this material to avoid unnecessarily high temperatures which might cause boiling of the solution, degradation of the tripolyphosphate ion, among others. The sodium tripolyphosphate is added to the solution and is readily dissolved therein. Naturally, care should be exercised during the addition step to avoid lumping or other similar problems which might arise which may extend the time needed to dissolve the tripolyphosphate salt.

In another preferred method the product may be formed by admixing all the ingredients of the formulation at room temperature and then heating this mixture to a sufficiently high temperature (e.g., about 180° F.) to dissolve substantially all the builder salt.

It has been found that the presence of certain water-soluble salts in the process may have a thickening effect of the composition. Thus, when the sodium dodecyl benzene sulfonate has been produced by sulfonation with oleum, and thus contains significant proportions of sodium sulfate, higher viscosities are obtained, which may be attributed to the relatively high sodium sulfate content of the commercial source of this material. Less viscous compositions are obtained when using detergent prepared by sulfonation with $SO_3$. Amounts of the salt e.g. sodium sulfate, may be up to about 5%, but amounts of about 1% to about 3%, e.g., are preferentially employed for this purpose. Excessive amounts of salt content may cause product instability. Also contemplated herein is an in vitro formation of the detergent moiety as for example, by neutralizing the sulfonic acid form of the detergent in the process vessel.

In order to evaluate the laundry washing performance of the compositions of the invention over a wide range of uses the following tests were employed using commercially soiled swatches obtained from Test Fabric Inc.:(1) Cotton, (2) EMPA an (3) Nylon. Additional swatches were prepared by soiling cotton (4) and dacron/cotton (5) with Piscataway clay.

Hand Washing Test — Method A

Swatches 1, 2 and 4 are individually soaked for one hour in an 0.3%, by weight, aqueous bath of the composition having a temperature of about 80° F. and a hardness of 100 parts per million (p.p.m.). The swatches are then stroked together by hand 20 times, followed by a thorough water rinse.

Simulated Hand Washing Test — Method B

Using the same washing temperature, concentration and soaking as set forth for the Hand Washing Test, the swatches, which are soaked in a Tergotometer, are agitated therein at 100 r.p.m. for 60 seconds, followed by a thorough water rinse.

Simulated Machine Washing — Method C

This method is the same as the Simulated Hand Washing Test except that the washing step is extended to 10 minutes.

Mixed Soil Detergency Test — Method D

This method is the same as Method C except that swatches 1 through 5 are washed together at 0.1% and 0.2% concentrations, by weight, at 70° F. and 120° F.

The cleaning effectiveness is determined by measuring the reflectance of the test swatches by means of a Gardner Reflectometer before and after washing. The gain in reflectance (RD) of the soiled swatches is used as a measure of the amount of soil removed from the swatch.

The detergency and sudsing properties are further illustrated by the following dishwashing test. The test involves the washing of specially soiled dishes with a 0.15 weight % aqueous solution of the liquid detergent composition and counting the dishes washed before the suds disappeared. The temperature of the wash water is 120° F. and the hardness about 100 p.p.m.

Various embodiments of the present invention will now be illustrated by reference to the following specific examples. It is understood, however, that such examples are presented for purposes of illustration only, and the present invention is in no way to be deemed as limited thereby.

EXAMPLE 1

A stable, homogenous liquid detergent composition is prepared using the following procedure. A mixture of 46.5 parts water and 34.5 parts of an aqueous solution of sodium linear dodecyl benzene sulfonate (containing, by weight, 43.5% sulfonate, 6.5% sodium sulfate, balance essentially water) is heated, with agitation, to a temperature of about 175°–180° F. The heat source is removed and 15 parts of anhydrous sodium tripolyphoshate (about 25% Form 1) is added to the mixture. The agitation is increased as the mixture thickens and the mixing is continued until the sodium tripolyphosphate (STPP) is dissolved. Three (3) parts of lauric-myristic diethanol amide (LMDEA) is added to the agitated mixture. The mixture is then cooled to room temperature with stirring continuously. The pH of the resultant product is about 11.7 and the pH of a 1% aqueous solution is about 10. The viscosity measured at 90° F. with a Brookfield Viscometer, Model No. RVF, using a No. 4 spindle at 4 revolutions per minute (r.p.m.) is 28,000 centipoises (cps.). This product exhibited excellent stability for a test period of 4 weeks at both 90° F. and 120° F. and indications are that the product is stable for periods up to at least six months, or more.

The product is tested for phosphate concentration and the results indicate that greater than 90% of the phosphate is retained as tripolyphosphate, with about equal amounts of pyrophosphate and orthophosphate being present.

The phosphorous analysis was performed using an ion exchange column to separate the different phophorous compounds, to wit, orthophosphates, pyrophosphates and tripolyphosphates. The fractions are then analyzed colorimetrically to determine the amount of each compound.

This product is comparatively tested with commercial heavy-duty liquid detergents for laundry cleaning using Methods A-D and for dishwashing effectiveness as set forth hereinabove. The results of the tests show that the product provides at least equivalent cleaning performance. Similar results are obtained when the hexahydrate form of sodium tripolyphosphate is employed.

Example 1 is repeated except that the LMDEA is omitted with a corresponding increase in water. This formulation containing no LMDEA separates immediately upon standing.

EXAMPLE II

Example I is repeated except that the sulfonate detergent is prepared by the $SO_3$ process and is 25.6 parts (and contains, by weight, about 58% sodium dodecyl benzene sulfonate, less than about 1% sodium sulfate and the balance essentially water), the sodium tripolyphosphate is 20 parts and the lauric-myristic diethanolamide is 5.5 parts. The viscosity at 90° F. is 24,000 cps. The pH of the formulation is about 10.4 and the pH of a 1% aqueous solution is about 9.8. Similar stability and cleaning results are achieved.

Reducing the amount of LMDEA to about 3% results in a stable, homogeneous product having characteristically good stability and cleaning properties and a viscosity of about 8,000 cps.

This product is tested for stability and insoluble particles by centrifuging in a Sewall Superspeed Centrifuge, Model 551A, for about 30 minutes at approximately 16,000 revolutions per minute (r.p.m.), which represent a g force of about 32,700. No separation of the product occurred and there is no perceptible amount of settled particles. This product is particularly suitable for uses requiring good drainage from a measuring container, e.g., machine washing of clothes.

EXAMPLE III

Example I is repeated using cocomonoethanolamide as the emulsifying agent. Substantially similar results are obtained.

EXAMPLE IV

Example I is repeated using sodium cetylbezene sulfonate with essentially the same results being obtained.

It will be apparent that many changes and modifications of the several features described herein may be made without departing from the spirit and scope of the invention. It is therefore apparent that the foregoing description is by way of illustration of the invention rather than limitation of the invention.

I claim:

1. In a process for preparing a stable, aqueous, heavy duty liquid detergent containing by weight from about 5% to about 50% water soluble anionic detergent and from about 5% to about 50% builder salt in water, the improvement wherein the builder salt in water is heated at an elevated temperature above about 60° in the presence of a stabilizing amount of fatty acid amide emulsifying agent and thereafter cooling the mixture to below about 40° C, the amount of builder salt dissolved in said water at said elevated temperature being greater than the solubility of said builder salt in water at said lower temperature.

2. A process as in claim 1 wherein the builder salt is a phosphate and the amide emulsifying agent is present in the amount of about 0.1% to about 20% by weight.

3. A process as in claim 2 wherein the anionic detergent is an alkyl benzene sulfonate detergent, the phosphate salt is tripolyphosphate and the amide emulsifying agent is a $C_{10}$ to $C_{22}$ fatty acid amide.

4. A process as in claim 3 wherein the detergent is an alkali metal $C_8$ to $C_{22}$ alkyl benzene sulfonate, and the builder salt is sodium tripolyphosphate.

5. A process as in claim 4 wherein the amount of detergent ranges from about 5 to about 30%, the amount of builder salt from about 5 to about 30% and the amount of amide emulsifying agent to from about 0.1% to about 10%.

6. A process as in claim 4 wherein the emulsifying agent is an alkylolamide and is present in an amount of about 1% to 6%.

7. A process as in claim 6 wherein the amount of alkyl benzene sulfonate ranges from 10 to 20%, the amount of sodium tripolyphosphate ranges from 10 to 20% and the amount of alkylolamide ranges from about 2 to 4%.

* * * * *